US006924726B2

(12) United States Patent
Ekwall

(10) Patent No.: US 6,924,726 B2
(45) Date of Patent: Aug. 2, 2005

(54) LIQUID-COOLED HIGH-POWER RESISTOR

(75) Inventor: Olle Ekwall, Ludvika (SE)

(73) Assignee: ABB AB, Västerås (SE)

( * ) Notice: Subject to any disclaimer, the term of this patent is extended or adjusted under 35 U.S.C. 154(b) by 0 days.

(21) Appl. No.: 10/299,022

(22) Filed: Nov. 19, 2002

(65) Prior Publication Data

US 2004/0095224 A1 May 20, 2004

(51) Int. Cl.[7] ..... H01C 10/14

(52) U.S. Cl. ..... 338/319; 101/52; 101/53; 101/104

(58) Field of Search ..... 338/52, 53, 54, 338/55, 56, 57, 58, 61, 101, 104, 105, 319

(56) References Cited

U.S. PATENT DOCUMENTS 1,505,072 A * 8/1924 Walmsley ..... 219/553
2,147,481 A * 2/1939 Waterton et al. ..... 338/55
2,736,785 A * 2/1956 Du Bois ..... 338/58
2,868,937 A * 1/1959 Charbonneau ..... 338/287
3,636,493 A * 1/1972 Caddock ..... 338/52
4,319,216 A * 3/1982 Ikeda et al. ..... 338/61
4,420,739 A * 12/1983 Herren ..... 338/53
4,630,024 A * 12/1986 Allen ..... 338/58
5,199,791 A * 4/1993 Kasanami et al. ..... 374/185
5,353,005 A * 10/1994 Salanki ..... 338/55
6,094,129 A * 7/2000 Baiatu ..... 338/22 R
6,166,619 A * 12/2000 Baiatu et al. ..... 338/61
6,194,990 B1 * 2/2001 Lee et al. ..... 338/320

* cited by examiner

*Primary Examiner*—Karl D. Easthom
(74) *Attorney, Agent, or Firm*—Dykema Gossett PLLC

(57) ABSTRACT

A high-power resistor comprises a plurality of resistor elements (1), made of sheets of an electrically conductive resistance material, with a first (13) and a second (14) terminal. The resistor elements are mutually separated by disc-shaped insulating first shims (2). Said first and second terminals are connected to adjacently located resistor elements so that the respective first terminals are connected to a first terminal and that the respective second terminals are connected to a second terminal. Two adjacent resistor elements form a current path, whereby, viewed in a direction perpendicular to the plane of the sheets, said first and second terminals, respectively, are so mutually positioned that, for a current supplied thereto, the current path in one resistor element substantially overlaps the current path in an adjacent resistor element and hence carries current in mutually opposite directions in the two adjacent resistor elements.

8 Claims, 8 Drawing Sheets

LIQUID-COOLED HIGH-POWER RESISTOR

TECHNICAL FIELD

The present invention relates to a liquid-cooled, high-power resistor for use in electric power current circuits.

BACKGROUND ART

A plurality of methods for manufacturing high-power resistors for use in electric power current circuits are known.

According to one known design, the resistor comprises mats of woven glass fibre with resistance wires woven into these mats, and according to another known design the resistor is in the form of a package of folded sheet-metal strips.

According to a further known design, the resistor is composed of electrically conductive ceramic blocks.

These types of resistors are suited for air cooling and the designs are therefore relatively bulky.

There is a need of an improved design principle for resistors of the kind described in the introduction, which is very compact, which exhibits very low inductance and which, in addition thereto, permits efficient cooling by means of a liquid medium.

SUMMARY OF THE INVENTION

The object of the invention is to provide a resistor of the kind described in the introduction, which, by its design, is very compact, which exhibits very low inductance and which, in addition thereto, permits efficient cooling by means of a liquid medium.

According to the invention, this is achieved in that the resistor comprises a plurality of resistor elements, made of sheets of an electrically conductive resistance material, with a first and a second terminal, whereby the resistor elements are mutually separated by disc-shaped insulating first shims, and said first and second terminals are connected to adjacently located resistor elements so that the respective first terminals are connected to a first terminal and that the respective second terminals are connected to a second terminal such that two adjacent resistor elements form a current path, whereby, viewed in a direction perpendicular to the plane of the sheets, said first and second terminals, respectively, are so mutually positioned that, for a current supplied thereto, the current path in one resistor element substantially overlaps the current path in an adjacent resistor element and then carries the current in mutually opposite directions in the two adjacent resistor elements.

In an advantageous further development of the invention, each one of the resistor elements is formed substantially as a circular ring with an outer and an inner element diameter, divided by a continuous radial slit, whereby said first and second terminals are arranged adjacent to the slit on both sides thereof.

In another advantageous further development of the invention, each one of the first shims substantially has the shape of a circular ring.

In still another advantageous further development of the invention, the first shims comprise a plurality of radially extending channels such that radially extending flow paths for a cooling medium are formed, which, in the plane of the sheets, are limited by two adjacent resistor elements and which, via gaps, communicate with a cylinder-shaped space limited by the inner edges of the resistor elements and of the first shims, respectively, and with a space in a radial direction outside the outer edges of the resistor elements and the first shims, respectively.

In yet another advantageous further development of the invention, the resistor comprises a first blocking means to block that flow path for the cooling medium which is constituted by a space limited by the inner wall of the container and the outer edges of the resistor elements and the first shims, respectively.

In another advantageous further development of the invention, the resistor comprises a second blocking means to block that flow path for the cooling medium which is constituted by a cylinder-shaped space that is limited by the inner edges of the resistor elements and the first shims, respectively.

Additional advantageous further developments of the invention will be clear from the following description and the appended claims.

With a resistor according to the invention, a very compact solution is obtained, which has a very low inductance and which, with the further developments described above, permits efficient cooling.

BRIEF DESCRIPTION OF THE DRAWINGS

The invention will be described in greater detail by description of embodiments with reference to the accompanying drawings, wherein.

DESCRIPTION OF THE PREFERRED EMBODIMENTS

Figure 1:
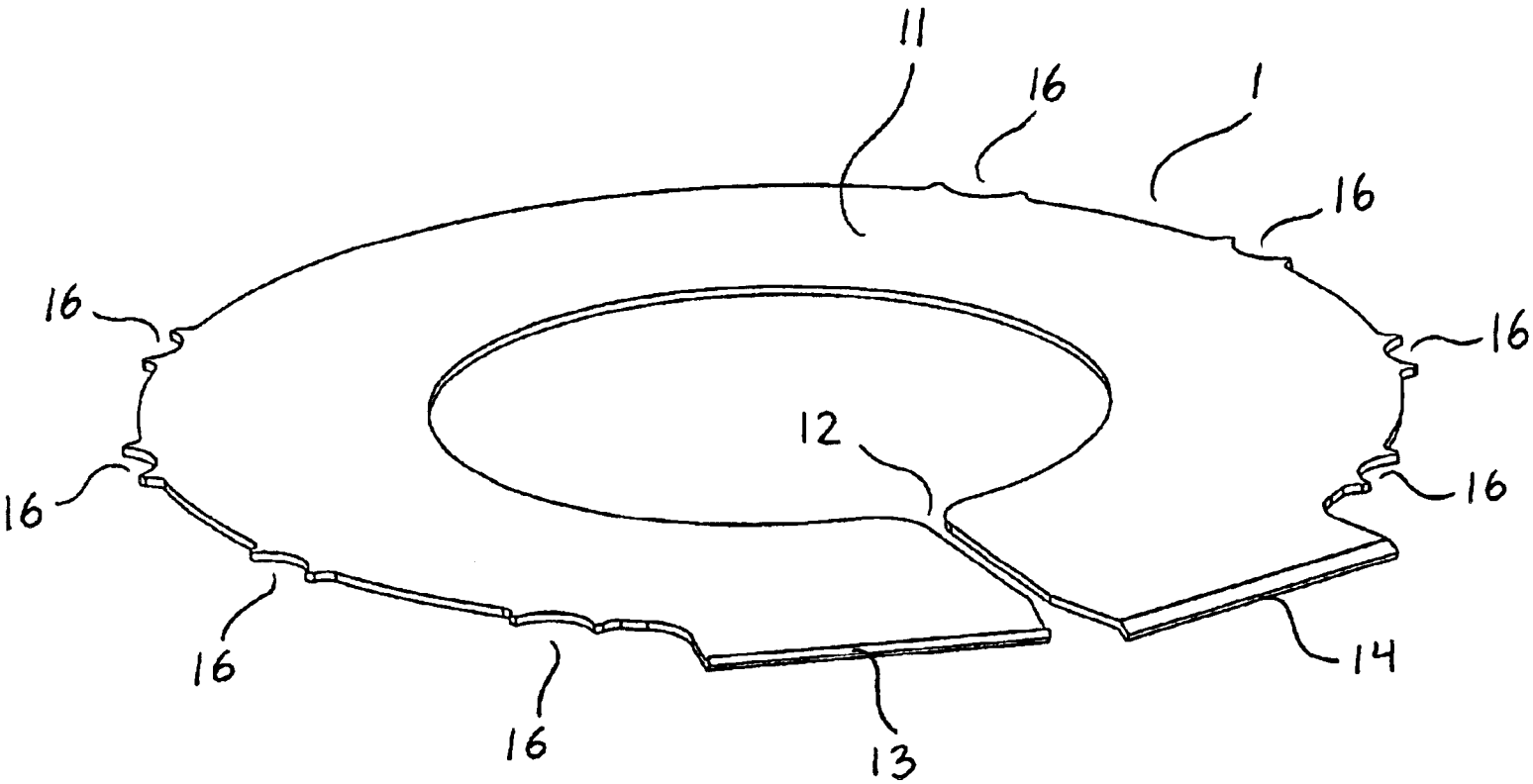
FIG. 1 shows, in perspective view, a resistor element according to the invention.

FIG. 1 shows, in perspective view, an embodiment of a resistor element 1 in the form of a disc-shaped circular ring 11.

The ring is split by means of a continuous radial slit 12 and exhibits, on both sides thereof outside the outer periphery of the ring, protruding straight edges 13 and 14. As is clear from the figure, the radially outermost edge 13 is bent in one axial direction and, correspondingly, the edge 14 is bent in the other axial direction.

The resistor element is made of a sheet of a suitable electrically conductive resistance material, preferably stainless steel.

Along the outer periphery of the circular ring, recesses 16 re arranged, the function of which will be described in greater detail below.

Figure 7:
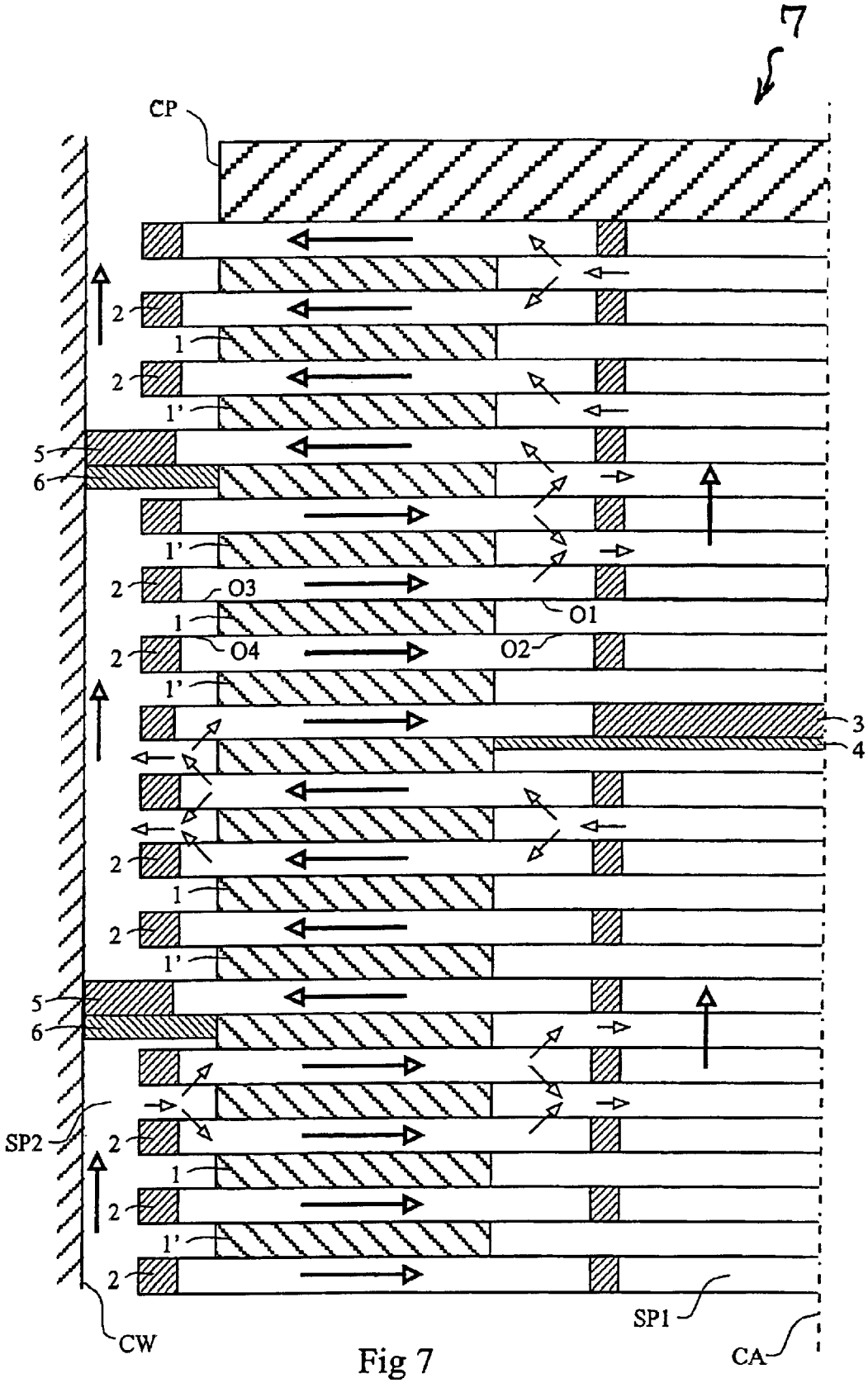
FIG. 7 shows part of a resistor according to the invention, and FIG. 8 schematically shows an electric wiring diagram for part of a resistor according to the invention.
Figure 8:
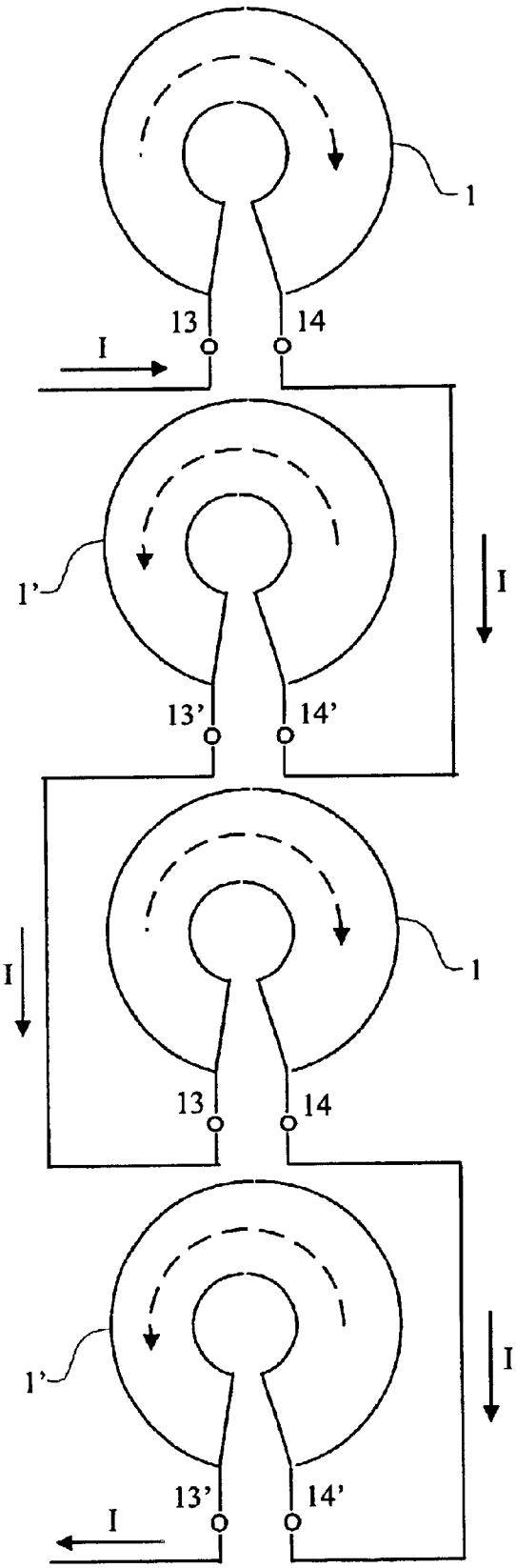

A variant of the resistor element 1, designated 1' in FIGS. 7 and 8, but otherwise not shown in a special figure, is identical with the resistor element 1 and thus exhibits edges 13' and 14', however, with the difference that these edges are not bent in the axial direction.

As will be described in greater detail below, the above-mentioned edges constitute, from an electrical point of view, terminals for connection of the resistor elements to each other or to an outer circuit.

FIGS. 2–6 show embodiments of shims and parts of shims, the function of which will be described in greater detail below. All the shims are disc-shaped and made of an insulating material, preferably of glass-fibre-reinforced epoxy, but also other resins or materials are feasible.

Designations such as circular ring and outer and inner diameter for this circular ring shall mean, in this context, the main basic form of the intended object. The resistor elements define a plane with a radial direction from a conceived axis, perpendicular to the plane, in the centre of the circular ring out towards the outer periphery thereof. A tangential direction in the plane of the sheets is perpendicular to the radial direction. A resistor element thus has two flat sides. By the edge of the resistor element is meant a surface that defines its extent in an axial direction. The corresponding situation applies to the shims described below.

Figure 2:
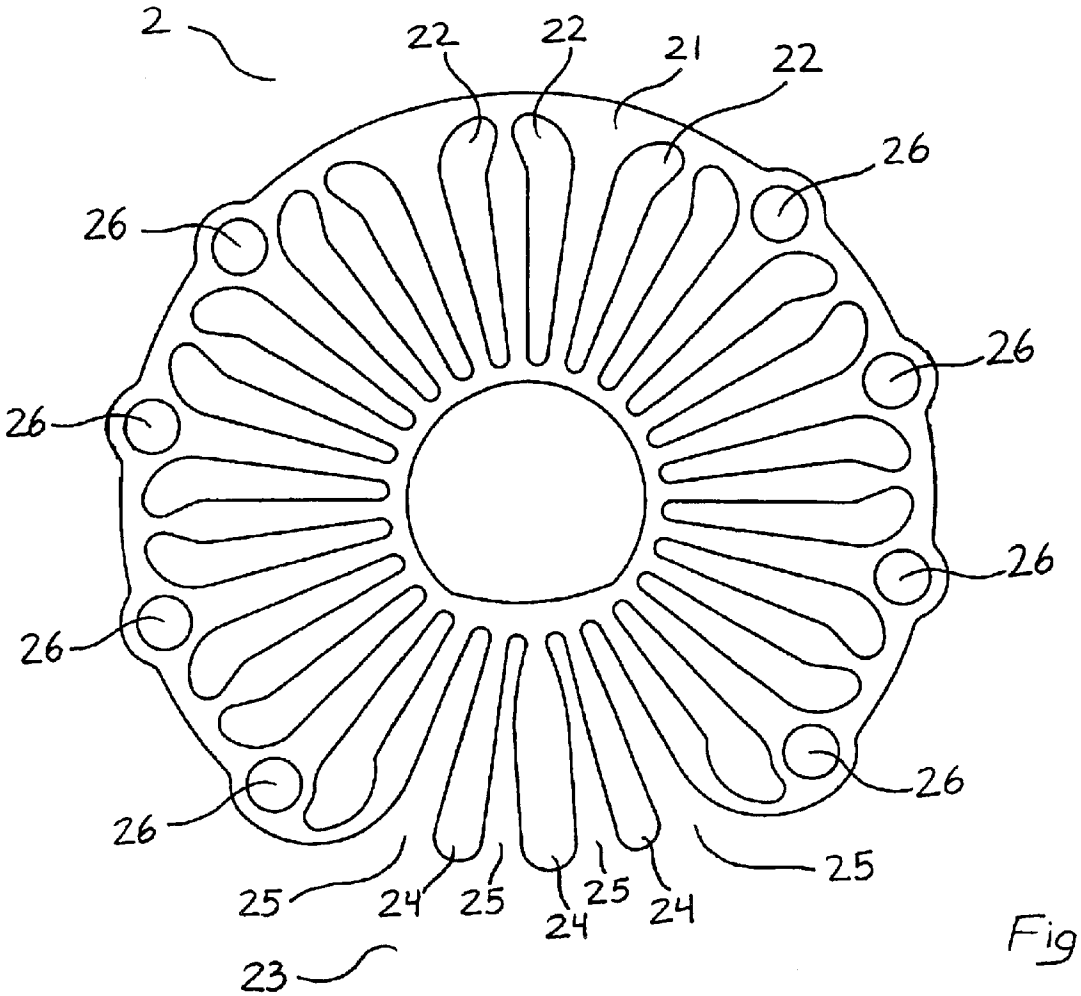
FIG. 2 shows a first shim according to the invention.

FIG. 2 shows a first shim 2 according to the invention, which substantially is in the form of a disc-shaped circular ring 21. The ring is provided with a plurality of radially-extending slits 22 perforating the ring in its axial direction. Only three of the slits have been provided with reference numerals in the figure but it is clear from the figure that these are uniformly distributed along the circumference of the ring 21.

At one location 23 along the periphery of the ring, the shim is formed as a number of tongues 24, in this embodiment three tongues, which define intermediate axial openings 25. The slits 22 and the tongues 24 extend radially between the outer and inner peripheries of the ring 21 with a radial extension that is smaller than the dimension of the ring in the radial direction so that the slits and the tongues, respectively, viewed from the centre of the ring, have an inner limitation lying outside the inner diameter of the ring and an outer limitation lying inside the outer diameter of the ring.

The shim is provided with eight through-holes 26 for assembly with resistor elements in a manner to be described in greater detail below.

Figure 3:
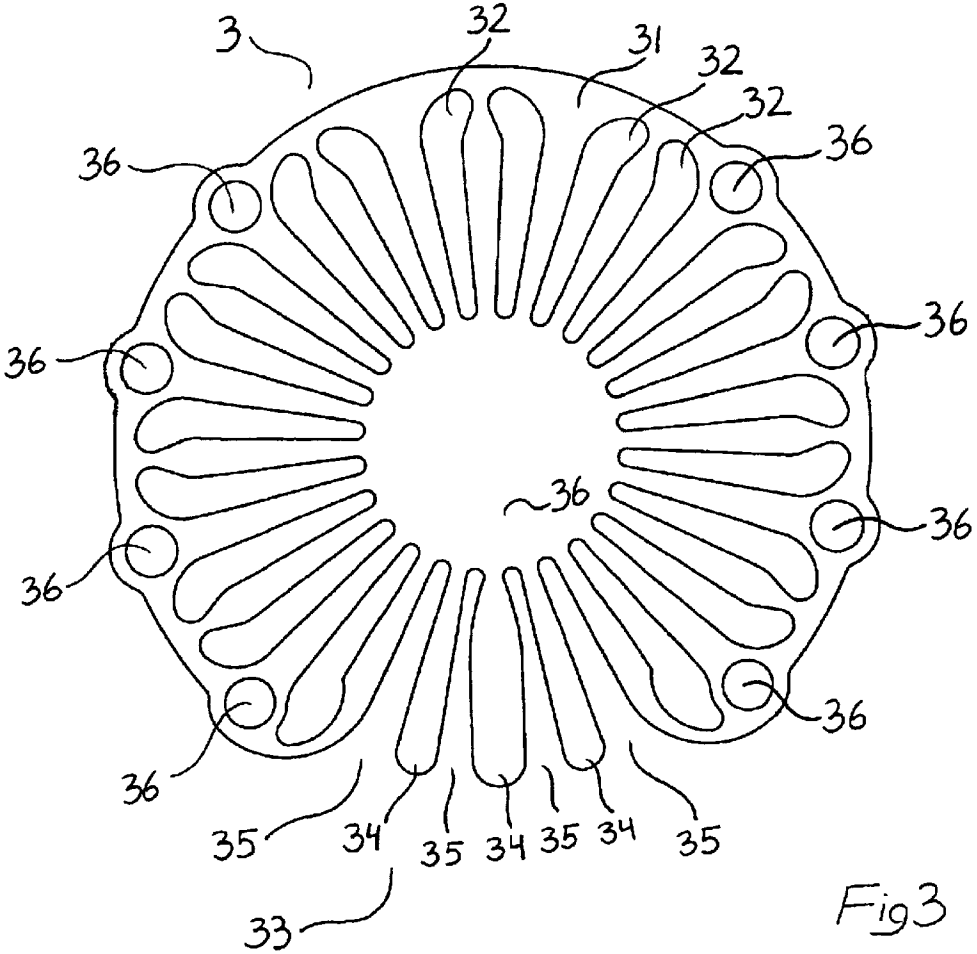
FIG. 3 shows part of a third shim according to the invention.

FIG. 3 shows a part 3 of a third shim that, contrary to the first shim 2 described above, is shaped substantially as a disc 31, provided with a number of radially extending slits 32 perforating the disc in its axial direction. Only three of the slits have been provided with reference numerals in the figure but it is clear from the figure that these are uniformly distributed along the circumference of the disc 31.

At one location 33 along the periphery of the disc, the shim is formed as a number of tongues 34, in this embodiment three tongues, which define intermediate axial openings 35. The slits 22 and the tongues 34 have a radial extension lying inside the periphery of the disc so that the slits and the tongues, respectively, viewed from the centre of the ring, have an outer limitation lying inside the outer diameter of the ring.

The shim 3 is provided with eight through-holes 36 for assembly with resistor elements in a manner to be described in greater detail below.

Figure 4:
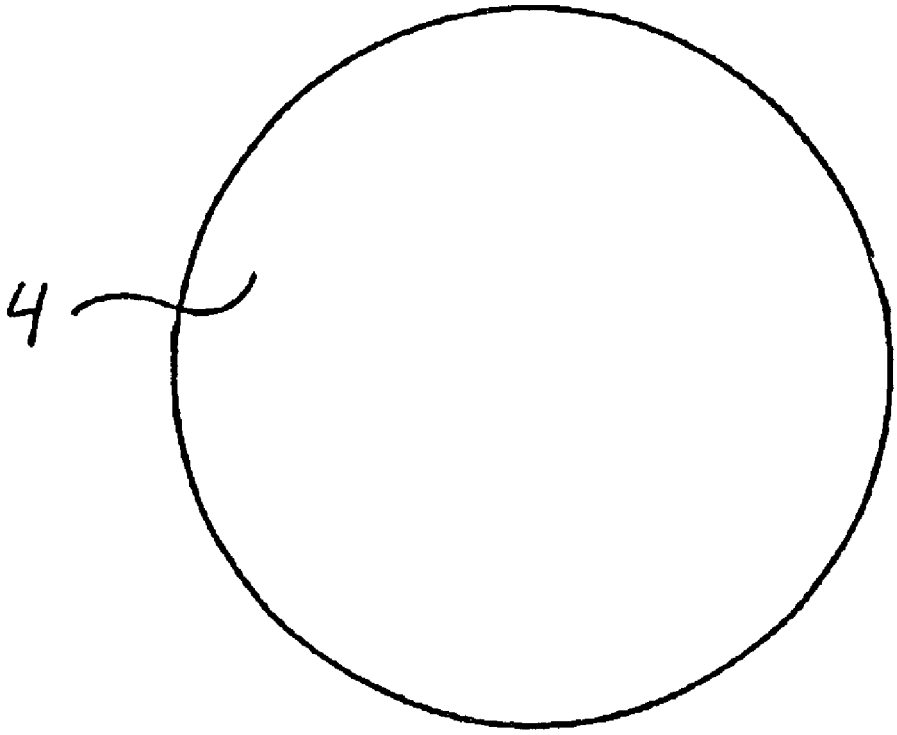
FIG. 4 shows another part of the third shim.

FIG. 4 shows another part 4 of the third shim that has the shape of a circular disc. The outer diameter of the disc 4 is preferably essentially equal to the inner diameter of the resistor element.

Figure 5:
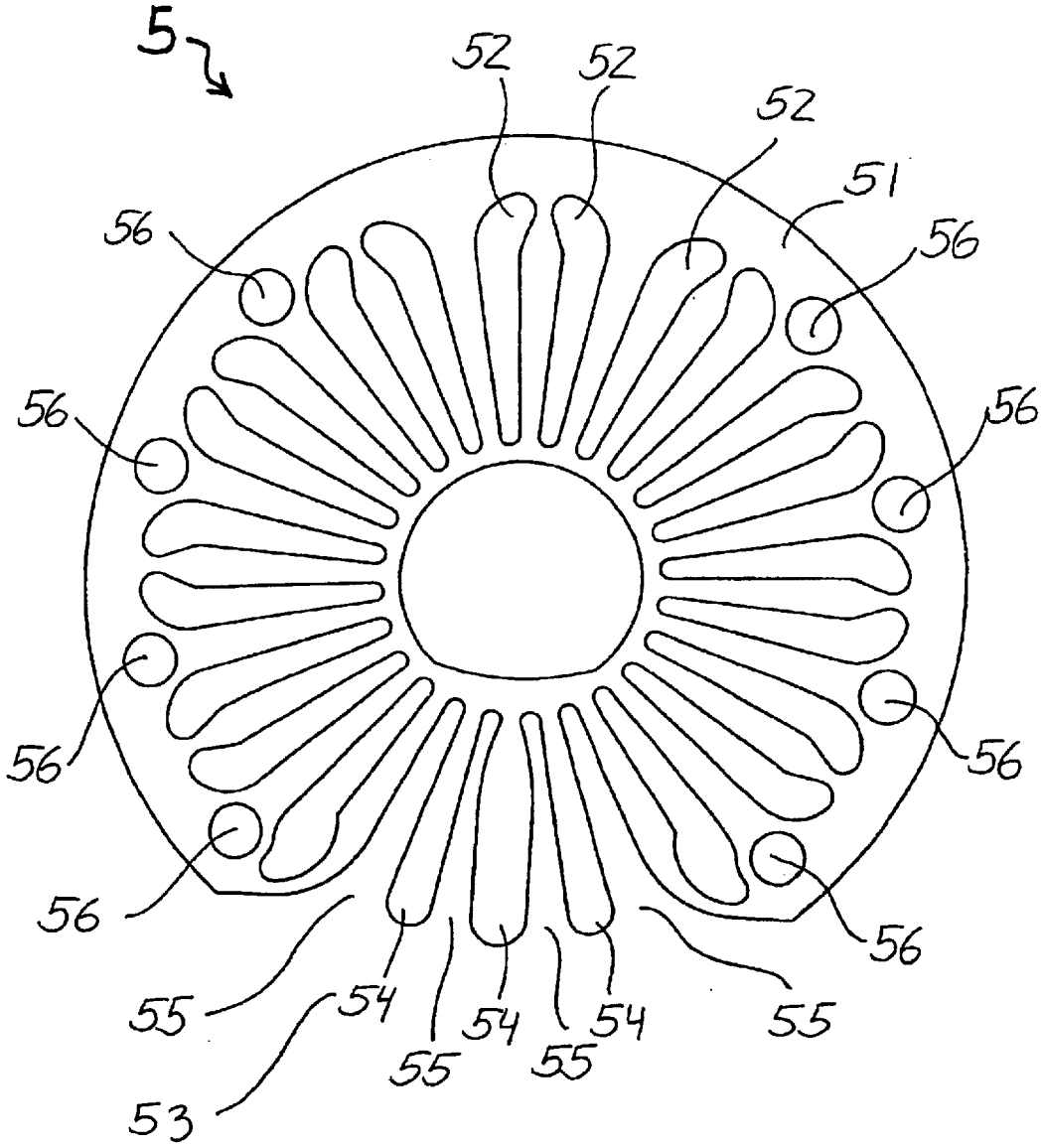
FIG. 5 shows part of a second shim according to the invention.

FIG. 5 shows a part 5 of a second shim. This part 5 is typically of the same kind as the first shim 2 described with reference to FIG. 2, however, with the difference that, for the part 5, the outer diameter of the circular ring is preferably larger than the corresponding dimension for the shim 2. Otherwise, the part 5 may be described in a manner similar to that for the first shim 2, with the reference numerals 2*x* replaced by 5*x*.

Figure 6:
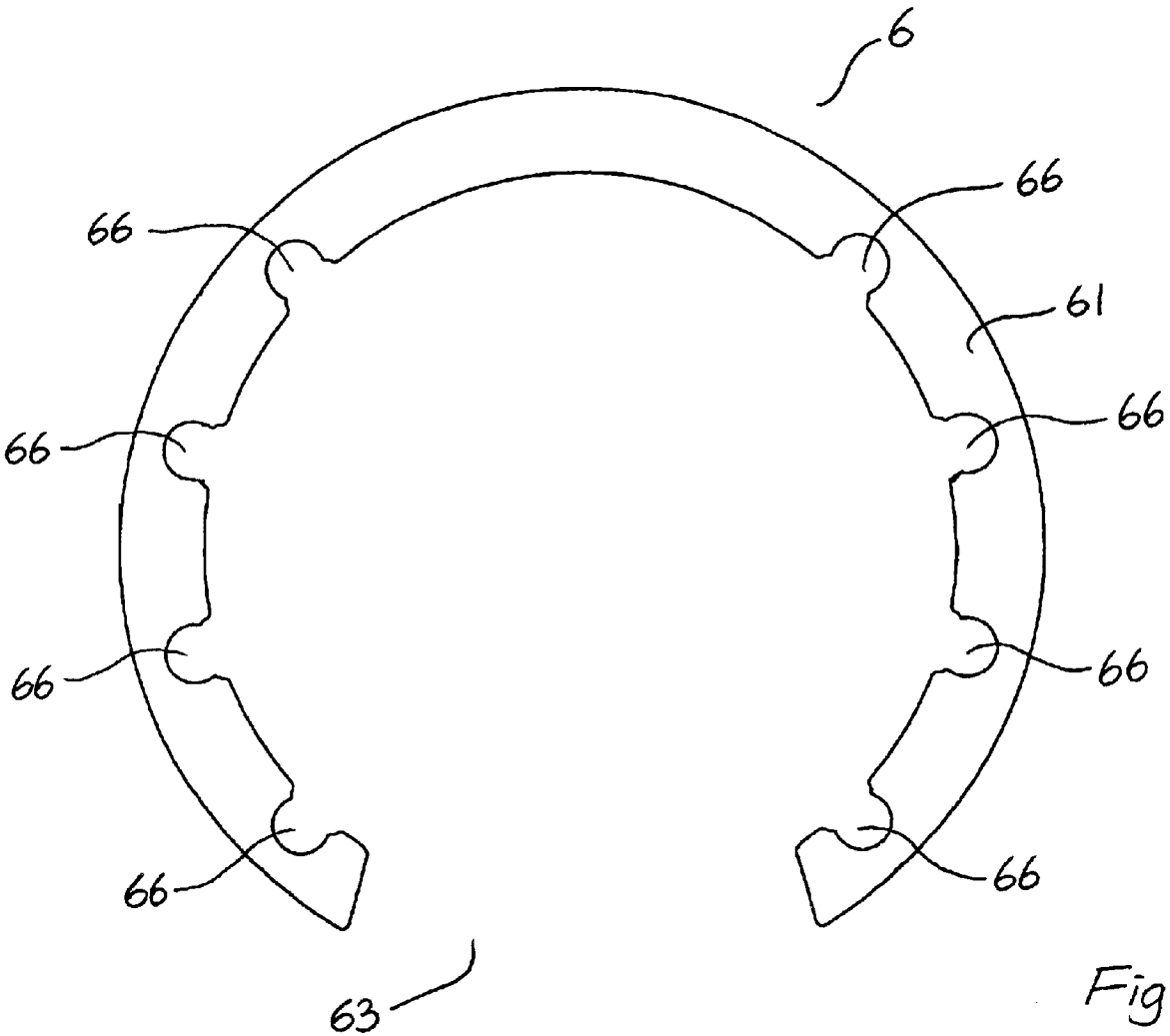
FIG. 6 shows another part of the second shim.

FIG. 6 shows a part 6 of the second shim that substantially has the shape of a circular ring 61, split up in an area 63. The extent of this area preferably corresponds to the area 53 for the part 5, where this shim is shaped as a number of tongues 54 defining intermediate axial openings 55.

The ring 61 has an outer diameter that preferably is the same as the outer diameter for the ring 51, and an inner diameter that is essentially equal to the outer diameter of the resistor element. The part 6 is provided with eight continuous recesses 66 for assembly with resistor elements in a manner to be described in greater detail below.

FIG. 7 shows part of a liquid-cooled high-power resistor 7, composed of the above-mentioned resistor elements and shims.

The figure shows a section through the resistor from a central axis CA through this to its periphery and through one of the above-mentioned slits.

The resistor is composed of a number of resistor elements arranged one above the other, each element being separated from the adjacent elements through shims in a manner to be described below. To facilitate interconnection of adjacently located resistor elements, which will be described in greater detail below, the resistor elements are arranged so that every other resistor element in the resistor is made as a resistor element 1 with bent edges and every other as a resistor element 1' with non-bent edges.

To avoid making the figure unclear, not every element or shim is provided with reference numerals, but it is to be understood that parts that are identically illustrated in the figure also are identical.

In a direction from the bottom and upwards, the figure shows a first shim 2, a resistor element 1', a first shim 2, a resistor element 1, a first shim 2, a resistor element 1', a first shim 2, and a resistor element 1, the three latter parts being without reference numerals in the figure.

Thereafter follows a second shim with the parts 6 and 5.

Then again follow a resistor element 1', a first shim 2, a resistor element 1, a first shim 2, a resistor element 1', a first shim 2, and a first resistor element 1, the three latter parts being without reference numerals in the figure. Thereafter follows a third shim with the parts 4 and 3. Then again follow, in succession, a resistor element 1', a shim 2, a resistor element 1, a shim 2, and so on.

The second shim arranged between the fourth and fifth resistor elements, counting from below in the figure, forms a first blocking means, the function of which will be described below.

The third shim arranged between the eighth and ninth resistor elements, counting from below in the figure, forms a second blocking means, the function of which will be described below.

Then again follow, in succession, a resistor element 1', a shim 2, a resistor element 1, a shim 2, and so on.

Between the 12th and 13th resistor elements, counting from below in the figure, a first blocking means is again arranged.

Then again follow, in succession, a resistor element 1', a shim 2, a resistor element 1, a shim 2, and so on.

A cylinder-shaped space SP1 is limited in a radial direction by the inner edges of the resistor elements and the first shims, respectively.

It is clear from the above that, in this embodiment, a sequence consisting of four resistor elements separated by three first shims forms a resistor group, and that each such resistor group is separated from the adjacent groups, either by the first blocking means or by the second blocking means. A resistor according to the invention may be built up of an arbitrary sequence of such combinations; however, it should be understood that the number of resistor elements in such a group, shown as four in the figure, may advantageously be chosen to be larger, typically, for example, 20 such elements.

For reasons to be described below, it may, however, be advantageous if the lower and upper ends of the resistor do not terminate in a first blocking means.

The resistor elements and the shims are enclosed in a container, which may preferably be in the form of a tube of polypropylene internally turned in a lathe, and the inner wall of which is indicated by the reference numeral CW in the figure.

An annular-cylindrically shaped space SP2 is limited in a radial direction by the inner wall of the container and the outer edges of the resistor elements and the first shims, respectively.

The container is provided at both ends with a cover, preferably of aluminium, which may be screwed to the tube.

In the embodiment described, the stack of resistor elements and shims is retained at both ends by insulating plates. The plates are retained by bolts, for example of glass-fibre-reinforced plastic, through the above-described holes 26, 36, 56 and 66 in the shims, these bolts also fitting the recesses 16 in the resistor elements. In FIG. 7, an upper plate CP is schematically indicated.

A current path through the resistor is created by welding together edges on adjacent resistor elements in a manner illustrated in FIG. 8. The uppermost resistor element 1 shown in the figure has non-bent edges 13 and 14, in the figure only indicated as connections to the resistor element, whereas the resistor elements shown therebelow are, in succession, alternately provided with bent edges (indicated by reference numerals 13' and 14') and with non-bent edges, respectively. The resistor elements are preferably oriented in a tangential direction such that their respective edges 13, 14 and 13', 14', respectively, lie above each other in the axial direction of the resistor. A current path through the uppermost resistor element and the resistor element immediately below the uppermost one in the figure is now formed by welding a non-bent edge 14 on the uppermost resistor element 1 to a bent edge 14' on the adjacent resistor element 1', in the figure shown as the element immediately below the uppermost one. A current I that is supplied to the uppermost resistor element via the edge 13 and is conducted away from the resistor element immediately below the uppermost one via the edge 13' thereof now forms, in the uppermost resistor element, a current path that follows the circular ring in the plane of the paper and the sheet in a clockwise direction, and, in the resistor element immediately below the uppermost one, a current path that follows the circular ring in the plane of the paper and the sheet in a counterclockwise direction.

The bent edge 13' of the resistor element located immediately below the uppermost one is welded to a non-bent edge 13 on the resistor element located immediately above the lowermost resistor element, and the edge 14 on the latter resistor element is welded to a bent edge 14' on the lowermost resistor element shown in the figure. The current I, supplied at the edge 13 of the uppermost resistor element shown in the figure, is conducted away from the resistor via the edge 13' in the lowermost resistor element shown in the figure.

In this way, as is clear from the above and as illustrated in FIG. 8, a current through the resistor will flow through the resistor elements with alternately clockwise and counterclockwise directions in the plane of the sheets. This means that the resistor will exhibit a very low inductance, which normally is desirable and in many applications a requirement.

Connection to an external circuit takes place by passing a flexible conductor, preferably of stainless steel, from the respective uppermost and lowermost resistor elements to a bushing in the respective cover, for example centrally placed therein.

To cool the resistor, cooling liquid is supplied, preferably in the form of deionized water, in the embodiment described at the lower part of the resistor, and is discharged at the upper part of the resistor. The cooling liquid is, respectively, supplied to and discharged from the resistor through preferably eccentrically located openings in the covers and is thus then passed into the resistor elements at the outer edge thereof, that is, essentially close to the wall CW of the container.

The shims have two functions, namely to extend the current path by electrically insulating the resistor elements from each other, but also to guide the flow of the cooling liquid directly towards the elements.

The slits in the first shims thus form a plurality of radially extending channels so as to form radially extending flow paths for the cooling liquid. The channels are limited in the plane of the sheets by two adjacent resistor elements and communicate via gaps with the cylinder-shaped space, which is radially limited by the inner edges of the resistor elements and the first shims, respectively, and with a space in a radial direction outside the outer edges of the resistor elements and the first shims, respectively.

The gaps are illustrated in FIG. 7 by reference numerals 01, 02, 03, and 04.

In the embodiment shown in FIG. 7, the cooling liquid has a general movement, counting from below and upwards in the figure, but is controlled by the shims also in a radial direction. Arrows in the figure indicate the radial flow direction of the cooling liquid between the resistor elements and its axial flow direction between the inner wall of the container and the outer edges of the resistor elements and the first shims, respectively, and centrally in the resistor inside the inner edges of the resistor elements and the first shims, respectively.

In the embodiment described, with the cooling liquid supplied at the outer edge of the resistor elements, there is obtained in the lower part of the resistor a flow in a radial direction from the periphery towards the central axis CA. However, because of the dimensions of the first blocking means 5 and 6 in relation to the resistor elements and to the container, and as is clear from the figure, the effect of these blocking means is that the liquid flow in an axial direction in the space between the wall of the container and the outer edges of the resistor elements and the first shims, respectively, is blocked. Above the first blocking means, therefore, the liquid flow, as is indicated in the figure, will be forced to flow along the resistor elements in a radial direction from the central axis CA towards the periphery.

As a result of the dimensions of the second blocking means 4 and 3 in relation to the resistor elements, and as will be clear from the figures, the effect of these blocking means is that the liquid flow in an axial direction at the central parts of the resistor is blocked.

Above the second blocking means, therefore, the liquid flow, as is indicated in the figure, will be forced to flow along the resistor elements in a radial direction from the periphery of the resistor towards the central axis CA.

With respect to control of the cooling liquid, two extreme cases in the design of the resistor are feasible. A resistor without either the first or the second blocking means leads to a large number of parallel-connected channels and a large area for the flow path of the cooling liquid through the resistor. If, on the other hand, the first respective blocking means is alternately arranged at every other resistor element, this leads to a large number of series-connected channels and a small area for the flow path of the cooling liquid through the resistor. Thus, by a suitable choice of the number of blocking means in the resistor, the pressure drop, the flows and the flow rate of the cooling liquid in the resistor may be optimized. In addition thereto, the area of the channels is, of course, influenced by the thickness of the other shims.

The resistor elements may preferably, and with good precision, be manufactured by numerically controlled water cutting, laser cutting, or milling of sheets of the electrically conductive resistance material.

In a typical embodiment, the outer diameter of the ring 11, for the resistor elements, is 210 mm and the inner diameter thereof is 114 mm. The thickness of the resistor element in the axial direction is then typically 1,5 mm.

For the first shim, the outer diameter of the ring 21 is then 238 mm and the inner diameter thereof is 70 mm, for the second shim the outer diameter of the disc 31 is 238 mm and exhibits, at the centre, a coherent part 36 with a diameter of 80 mm. The shim 2 and the disc 3 have in their axial directions a thickness of typically 1.5 mm.

The outer diameter of the disc 4 is then 113 mm, the inner diameter of the container is 258 mm, the outer diameter of the ring 51 is 258 mm, and the inner diameter thereof is 70 mm. The outer diameter of the ring 61 is then 258 mm, and the inner diameter thereof is 211 mm. In its axial direction the disc 4 has a thickness of typically 0.5 mm.

In its axial direction, the disc 6 has a thickness of typically 1.0 mm.

Typically, a complete resistor may comprise around 150–200 resistor elements with a resultant resistance in the range of 0.5–1 ohm. The load resistance typically amounts to 50 kW continuous power and for brief periods an absorption capacity of the order of magnitude of 700 kJ.

Typical applications for the resistors described are filter circuits in installations for transmission of high-voltage direct current, damping of high-frequency oscillations, current limitation in case of failures in electric installations, and, for example, grounding resistors. Other feasible applications are for experimental erections in high-power laboratories.

The invention is not limited to the embodiments shown but the person skilled in the art may, of course, modify it in a plurality of ways within the scope of the invention as defined in the claims in order to achieve the desirable resistance and rated power.

Thus, each of the resistor groups mentioned above may be formed from a number of resistor elements suitable for this purpose, and such resistor groups, separated by direction-influencing blocking means as described above, may then be stacked on top of each other until the desired resistance is achieved.

To facilitate the assembly, the location 23, at the first shim, along the circumference of the ring, where the shim is formed as a number of tongues 24, may advantageously be arranged so as to axially overlap the straight edges on the resistor element.

Alternatively, the first shim may be completely formed with tongues 24 instead of slits, in which case the function of the slits described above is achieved by the radially extending openings 25. The mentioned channels are thus formed from the openings 25 and are limited in a tangential direction by the tongues 24.

The corresponding condition applies also to the shim 3 included in the second blocking means.

Preferably, the first and second blocking means, respectively, may each be formed in two separate parts 5 and 6, and 3 and 4, respectively, which are glued to each other.

The first blocking means may alternatively consist of a resistor element formed with an outer diameter that is essentially equal to the inner diameter of the container.

What is claimed is:

1. A high-power resistor comprising a plurality of resistor elements (1) made of sheets of an electrically conductive resistance material, each resistor element having first (13) and second (14) terminals, and said resistor elements being mutually separated by ring-shaped insulating first shims (2), a first terminal of a first resistor element of the plurality of resistor elements being connected to a first terminal of an adjacent second resistor element of the plurality of elements, and a second terminal of the second resistor element being connected to a second terminal of an adjacent third resistor element of the plurality of resistor elements, thus forming a current path of serially connected resistor elements, wherein each of the resistor elements is formed as a ring with an outer element diameter and an inner element diameter, split by a continuous radial slit (12), and wherein said first and second terminals of each resistor element are arranged adjacent to the silt therein on both sides thereof, said first shims (2) each extending in a plane and comprising a plurality of radially-extending channels (22, 23) providing radially-extending flow paths for a cooling medium which are contained between two adjacent resistor elements and which, via gaps (01, 02, 03, 04), communicate with a cylinder-shaped space (SP1), limited in a radial direction by inner edges of the resistor elements and said first shims, respectively, and with a space (SP2) located in a radial direction outside outer edges of the resistor elements and the first shims, respectively.

2. A high-power resistor according to claim 1, wherein each of said first shims substantially has the shape of a circular ring with an inner diameter that is smaller than the inner element diameter and an outer diameter that is larger than the outer element diameter, and said channels consists of slits (22) extending radially from an outer diameter that is larger than the outer element diameter but smaller than the outer diameter of the shim, and an inner diameter that is smaller than the inner element diameter but larger than the inner diameter of the shim.

3. A high-power resistor according to claim 1, wherein each of said first shims substantially has the shape of a circular ring with a number of radially-directed tongues (24), the ring having an inner diameter that is smaller than the inner element diameter and the tongues extending in a radial direction outside the outer element diameter, and wherein said channels consist of openings (5) that are limited by said tongues in a tangential direction.

4. A high-power resistor according to claim 3, including a substantially cylindrical outer container so that flow paths for the cooling medium are formed in a direction substantially perpendicular to the plane of the sheets both in a cylinder-shaped space (SP1), limited in a radial direction by the inner edges of the resistor elements and said first shims, respectively, and in a space (SP2), limited in a radial direction by an inner wall (CW) of the container and by outer edges of the resistor elements and said first shims, respectively.

5. A high-power resistor according to claim 4, including a first blocking means (5, 6) for blocking that flow path for the cooling medium which is constituted by the space (SP2), limited in a radial direction by the inner wall of the container and the outer edges of the resistor elements and said first shims, respectively.

6. A high-power resistor according to claim 5, wherein said first blocking means comprises a disc-shaped insulating second shim (5,6) arranged between two adjacent resistor elements and substantially having the shape of a circular ring with an outer diameter that is essentially equal to the diameter of the inner wall (CW) of the container, said ring, in a direction perpendicular to the plane of the sheets, exhibiting a first part (6) with the circular ring split up in the tangential direction and with an inner diameter that is essentially equal to the outer element diameter, and a second part (5) with an inner diameter that is smaller than the inner element diameter, and with a plurality of radial slits (52) extending from an outer diameter that is larger than the outer element diameter and an inner diameter that is smaller than the inner element diameter.

7. A high-power resistor according to claim 6, including a second blocking means (3, 4) to block that flow path for the cooling medium which is constituted by the cylinder-shaped space (SP2), which in a radial direction is limited by the inner edges of the resistor elements and said first shims, respectively.

8. A high-power resistor according to claim 7, wherein said second blocking means comprises a disc-shaped insulating third shim (3,4), arranged between two adjacent resistor elements, substantially having the shape of a circular disc, which in a direction perpendicular to the plane of the sheets exhibits a first part (4) with a diameter that is essentially equal to the inner element diameter, and a second part (3) with an outer diameter that is smaller than the diameter of the inner wall of the container but larger than the outer element diameter, and with a plurality of radial slits (32) extending from an outer diameter that is larger than the outer element diameter but smaller than the outer diameter of said shim, and an inner diameter that is smaller than the inner element diameter.

* * * * *